United States Patent [19]

Hartman

[11] 4,030,255

[45] June 21, 1977

[54] FOLDING HANDRAIL SYSTEM FOR TELESCOPING SEATING SYSTEMS

[75] Inventor: Arlin Philip Hartman, Champaign, Ill.

[73] Assignee: Universal Bleacher Company, Champaign, Ill.

[22] Filed: June 28, 1976

[21] Appl. No.: 700,158

[52] U.S. Cl. ..... 52/9; 52/183; 182/106; 256/59; 256/65; 256/67

[51] Int. Cl.[2] ..... F04H 3/12

[58] Field of Search ..... 52/9, 10, 184, 183, 52/118, 111; 182/78, 106; 256/59, 65, 66, 67, 68, 69, 70

[56] References Cited

UNITED STATES PATENTS

| | | | |
|---|---|---|---|
| 699,509 | 5/1902 | Finnegan | 256/67 |
| 2,933,149 | 4/1960 | Lee | 182/78 |
| 3,401,918 | 9/1968 | Wiese | 52/9 X |
| 3,667,171 | 6/1972 | McClelland | 52/9 |
| 3,871,479 | 3/1975 | Pelto | 182/106 X |
| 3,964,215 | 6/1976 | Hartman et al. | 52/9 |
| 3,995,832 | 12/1976 | Wiese | 52/183 |

*Primary Examiner*—Leslie Braun

*Attorney, Agent, or Firm*—Tilton, Fallon, Lungmus, Chestnut and Hill

[57] ABSTRACT

A plurality of telescoping tubes form a rail assembly which is pivotally connected at its lower end to a post, a sleeve is slidably received in the uppermost tube which is provided with an upper stop ring and a lower ring to limit the motion of the sleeve. A link is pivotally connected between the sleeve and an upper post. Thus, as the seating system is extended for use or retracted for storage, the handrail also extends and retracts. A stop element on the link limits the position of the link in the extended position so that the axes of upper and lower rail assemblies are aligned. In a preferred embodiment, the posts are inclined forwardly so that the rail assemblies are vertical in the storage position.

8 Claims, 8 Drawing Figures

FOLDING HANDRAIL SYSTEM FOR TELESCOPING SEATING SYSTEMS

BACKGROUND AND SUMMARY

The present invention relates to folding handrails which are adapted for use with telescoping seating systems. Folding or telescoping handrails of this type are disclosed in U.S. Pat. No. 3,401,918 of Harold Wiese for "Foldable Handrail", and improvements are described in the co-owned application Ser. No. 550,478, filed Feb. 18, 1975, now U.S. Pat. No. 3,964,215 for "Improvements in Folding Handrails for Telescoping Seating Sections", of Hartman and Vance.

In telescoping seating systems of the type with which the present invention is concerned, the seating system is made from a number of individual row sections which are adapted to move relative to each other so that a lower row section telescopes beneath an upper row section when the system is retracted for storage. For use, the row sections are extended outwardly, and when fully opened, they are in stepped relation.

Prior to the systems disclosed in the above-referenced patent and application, most handrails for telescoping seating systems had to be removed prior to retraction, and after removal, the handrails were stored on the tread panels in the row sections. Such systems required the use of maintenance personnel to install handrails prior to use and to remove them prior to retraction of the seating system. Because it was necessary to mount the rails in such a way that they could not easily be tampered with or removed by occupants, such as students, the amount of time required to mount and remove the rail sections resulted in infrequent use of the rails. Typically, the handrails would be stored in a location apart from the seating system, and not always assembled when the seating system was extended for use. More recently, systems have been designed wherein the rail sections are secured permanentaly to the row sections and need not be removed when the seating system is retracted.

These latter systems employ a series of telescoping tubes to form an extensible rail assembly. If these rail assemblies have their lowermost tubes pivotally connected to a lower post and their uppermost tubes pivotally connected to an upper post, both posts being mounted to seating rows, the rail assemblies are designed for a particular rise and span. That is, the number of tubular elements and their length is determined by the rise and span of the system. The rise of a seating system normally refers to the height of each individual row; and the span normally refers to the row-to-row horizontal spacing in the extended position.

When referring to handrails and realizing that the posts may be spaced two or three rows apart, the vertical distance between corresponding points adjacent posts is referred to as accumulated rise, and the horizontal spacing between corresponding points on adjacent posts when the system is extended is referred to as accumulated span.

Prior rail assemblies cannot be adapted to seating systems of substantially different rise or span than those for which they were originally designed. When it is realized that rise and span may differ for different installations, may even vary within a given installation and certainly differ for different types of seating (for example, bleacher vs. folding chair), the problem will be understood.

The lack of versatility of a given handrail design is further accentuated because the handrail extends between two posts in the extended position; and, therefore, these connections act as a restraint in the folded or retracted position.

In a folding handrail, it is desirable to use, as the handrail assembly, a plurality of telescoping tubular elements. In theory, such an assembly may be telescoped to the length of a single elememt, and in the extended position, it may span an overall dimension equal to the number of individual tubular elements times the length of one element. However, in order to provide structural integrity, there is a need for some overlap between adjacent tubular elements. Hence, the effective extension for each individual tubular element is reduced by 20–25% (i.e., the actual length less the overlap). For long accumulated spans, it may seem a simple expedient to add more tubular elements to the handrail assembly, but this has two drawbacks (1) the number of elements for a short accumulated rise becomes excessive, and (2) the variation in diameter along a rail assembly becomes uncomfortable to the hand of a user. There are other disadvantages such as the lack of esthetic appeal, and the impracticality of manufacturing tubular elements of a large number of diameters.

In summary, telescoping handrail assemblies have had to be specially dimensioned for a given accumulated rise and accumulated span, and it has been difficult to adapt such assemblies to platform seating systems where the accumulated rise is relatively small.

In the present invention, a plurality of telescoping tubular elements form a rail assembly which is pivotally connected at its lower end to one post on the seating system. A sleeve is slidably received on the uppermost tubular element, and a link pivotally interconnects the sleeve with the upper post.

The uppermost tubular element of the rail assembly is provided with an upper peripheral stop ring and a lower peripheral stop ring. The upper ring engages the sleeve during extension of the seating system and holds it adjacent the pivotal connection to the upper post so that the rail assembly may be extended as the seating system is opened. The lower stop ring engages the lower portion of the sleeve when the seating system is closed, and this forces the rail assembly to its retracted position during storage.

An adjustable stop member is also provided on the link for engaging the associated post during extension of the system when the link is in proper alignment with its associated rail assembly. This insures that when the system is fully opened, all of the tubular elements are axially aligned, both for upper and lower rail assemblies.

With the present invention, then, when the seating system is closed, the rail assembly is telescoped to its shortened position, and the sleeve slides downwardly on the uppermost tubular element. This permits the rail assembly, in the closed position, to extend a distance which is greater than the distance between the pivotal connections of the rail assembly to its associated posts. That is to say, with the present invention, the retracted length is not limited to the accumulated rise between adjacent posts since the upper end of a rail assembly swings upwardly in the retracted position. The present invention accommodates longer tubular elements, and hence a fewer number, for a given accumulated span. With the present invention, the same handrail assembly can be used on seating systems with different rises. Because of the telescoping characteristic of the handrail assembly, it automatically accommodates to seating systems with different accumulated spans.

Further, by slanting the posts forwardly, the rail assemblies assume an upright position and storage. By mounting both the link and the lower tubular element of an upper rail assembly to a common pin, upper and lower rail assemblies may be used, and they will be aligned in the same vertical plane for all positions. This is desirable from both a functional and an esthetic viewpoint.

Other features and advantages of the present invention will be apparent from the following detailed description of a preferred embodiment accompanied by the attached drawing wherein identical reference numerals will refer to like parts in the various views.

THE DRAWING

DETAILED DESCRIPTION

Figure 1:
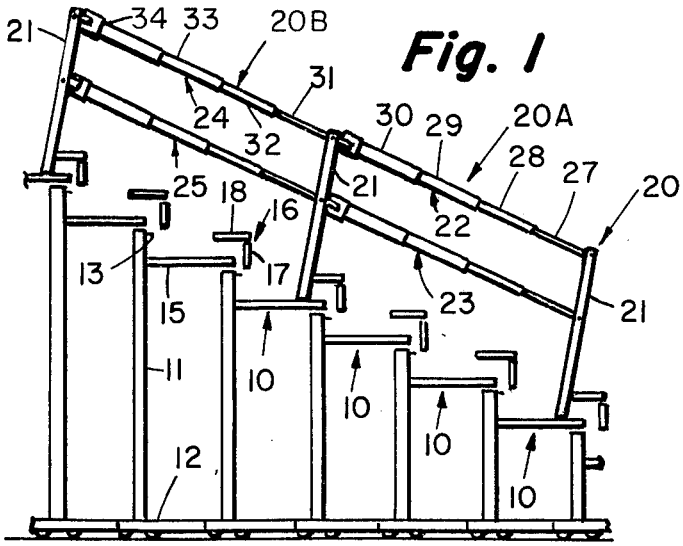
FIG. 1 is a diagrammatic, fragmentary side view of a seating system in the extended position and incorporating the present invention.

Referring now to FIG. 1, a portion of a telescoping seating system is shown in the extended or use position. The seating system includes a plurality of rows generally designated by reference numeral 10. Each of the rows 10 includes a pair of support posts (one of which is shown at 11). Each of the support posts is secured to a wheeled channel 12. The upper portions of the posts 11 are connected together by means of a riser beam, the upper flange of which is shown at 13; and a tread platform 15 is supported by the beam 13 and the posts 11. At the forward end of the tread panels there is provided in the illustrated embodiment a bleacher or bench-type seat generally designated 16 and including a forward riser panel 17 and a seat panel 18.

Figure 2:
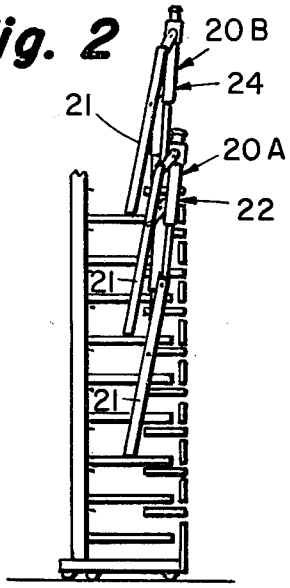
FIG. 2 is a view similar to FIG. 1 with the seating system retracted for storage.

The support posts 11 for each row are spaced at progressively narrower distances for the lower rows so that the lower rows may be moved beneath an upper row with the associated support posts nesting to side-by-side relation in the storage position, as seen in FIG. 2. Additional details concerning telescoping seating systems of this type may be obtained from U.S. Pat. No. 3,667,171, issued June 6, 1972. The present invention, however, is not limited to this particular type of construction, as persons skilled in the art will readily appreciate.

Still referring to FIGS. 1 and 2, a telescoping rail assembly is generally designated by reference numeral 20. It includes a number of upright, but forwardly inclined posts 21 which are secured at their bottoms to associated rows 10. One manner of securing the posts 21 to the rows is shown in the above-referenced application Ser. No. 550,478, now U.S. Pat. No. 3,964,215, so further details need not be given here.

It will be observed that the upright posts 21 are spaced so that a given rail section will span three rows. Thus, in the illustrated embodiment, two rail sections are shown—a lower rail section 20A and the upper rail section 20B. Each of these rail sections, in turn, includes an upper and a lower telescoping rail assembly, designated respectively 22, 23, 24 and 25. Each of the rail assemblies 22–25 is similar, and comprises a plurality of tubular elements which are arranged in telescoping relation. For example, the rail assembly 22 includes four tubular elements designated 27–30 respectively. Similarly, the tubular elements for the rail assembly 24 are designated respectively 31–34.

Figure 3:
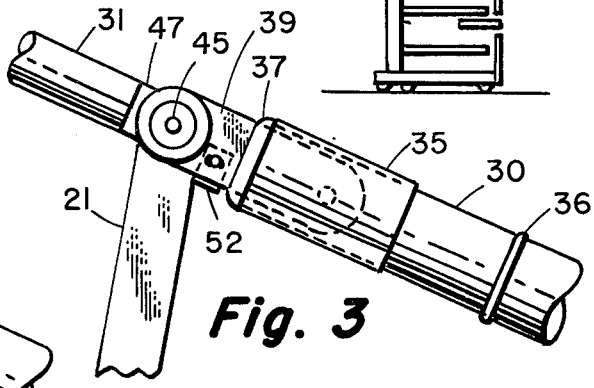
FIG. 3 is a close-up fragmentary view of the structure for interconnecting rail assemblies to a post according to the present invention with both the upper and lower rail assemblies extended in the use position.

Turning now to FIG. 3, a sleeve 35 is slidably received on the uppermost tubular element 30. The tubular element 30 is provided with a lower peripheral ridge 36 and an upper peripheral ridge 37. The ridges 36, 37 act as stop members or limiting means for engaging or limitig the motion of the sleeve 35 on the tubular element 30, as will be discussed more fully below.

Figure 6:
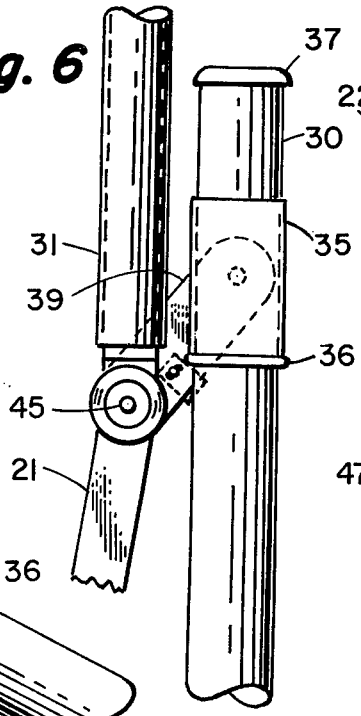
FIG. 6 is a view similar to FIG. 3 with both the upper and lower rail assemblies fully retracted for storage.
Figure 7:
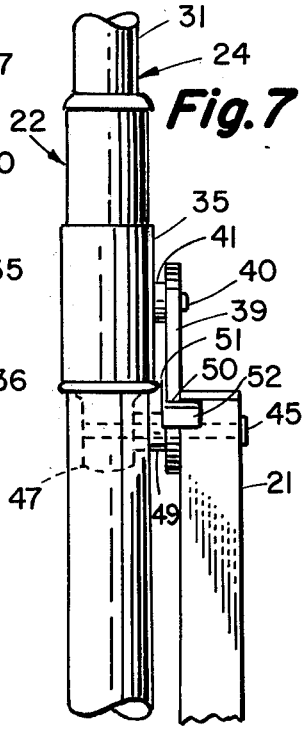
FIG. 7 is a front view of the structure shown in FIG. 6.

Referring now to FIG. 7, a link 39 is pivotally connected at 40 to the sleeve 35. The spacer 41 is interposed between the sleeve 35 and the link 39. The other end of the link 39 is journaled on a pin 45 which extends through the post 21 and is pivotally mounted to a knuckle 47 fitted into the lowermost tubular element 31 of the rail assembly 20B (see FIGS. 3 and 6). Referring again to FIG. 7, a spacer element 49 is fitted on the pin 45 and located between the link 39 and the knuckle 47. An L-shaped stop element 50 includes a first portion 51 which is mounted to the link 39 and a second portion 52 which extends beneath the link 39 and engages the post 21 when the link is lowered, as seen in FIG. 3.

Figure 4:
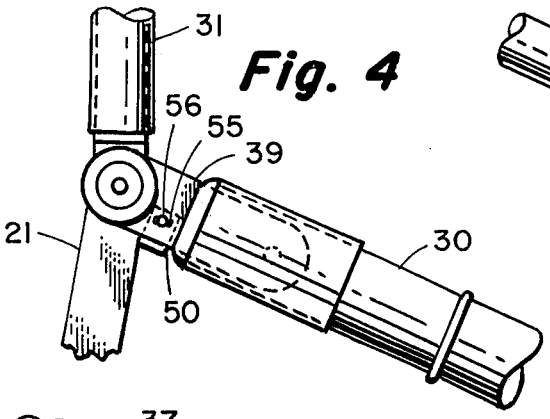
FIG. 4 is a view similar to FIG. 3 with the lower rail assembly extended and the upper rail assembly retracted.

The link 39 is provided with a slot 55 in FIG. 4. It will be observed that the slot 55 is elongated in the direction of elongation of the link 39, and it permits adjustment of the stop member 50 which is secured to the link 39 in the slot 55 by means of a threaded fastener 56. The stop element 50 is adjusted such that it contacts the post 21 when the link 39 is aligned with the axis of the tubular element 30—that is, in the fully extended position of FIG. 3, the angled portion 52 of the stop member 50 engages the post 21 to determine the position of the link 39 such that all tubular elements of the sections 20A and 20B are axially aligned.

OPERATION

The illustrated embodiment operates such that during extension of the rows to the use position, the lowest row is first extended, then the second lowest row, and so on. Similarly, during retraction, the lowest row is first retracted, then the second lowest row is retracted, and so on.

In the fully retracted or storage position shown in FIG. 2, the posts 21 are forwardly inclined such that the rail assemblies 22–25 are generally upright and do not protrude beyond the forward portion of the seating system when viewed in profile. This position, referring now to FIGS. 6 and 7 (which are views taken from the center of a row looking toward a right side handrail when looking up the seating section), it will be observed that the link 39 extends upwardly from its pivot connection 45, and that the sleeve 35 engages the peripheral stop ridge 36. The upper end of the tube 30 extends well above the sleeve 35. As best seen in FIG. 7, the rail assemblies 22 and 24 are aligned in a fore-and-aft direction. The lower rail assemblies 23, 25 are preferably mounted to the posts 21 in a similar manner so that all rail assemblies are on the inside of the posts 21, and the axes of all rail assemblies extend substantially in the same vertical plane—which plane is parallel to the opening and closing motion of the rows.

Figure 5:
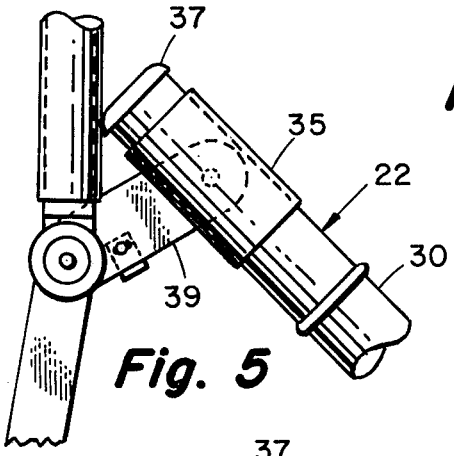
FIG. 5 is a view similar to FIG. 4 with the lower rail assembly partially retracted, and the upper rail assembly fully retracted.

As a lower row is extended for use, the rail assembly 22 becomes elongated, and the sleeve 35 travels higher on the uppermost tubular element 30, see FIG. 5, until it engages and is limited by the uppermost peripheral limit 37. As the rows continue to extend, the telescoping rail is likewise extended, and the link 39 rotates downwardly until the stop 50 engages the post 21 as seen in FIG. 4. As the upper rows continue to extend, the upper rail assembly 24 will extend in a similar manner, until both rails assembly are axially aligned as seen in FIG. 3.

Figure 3A:
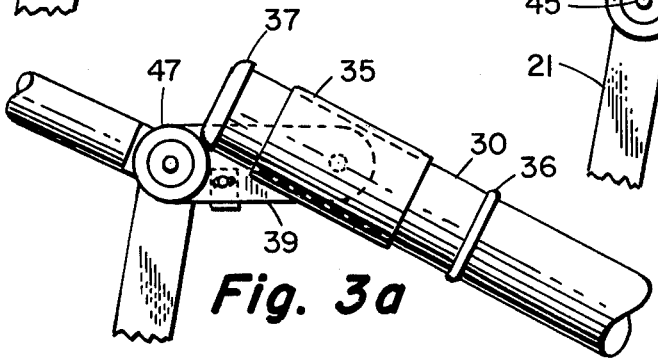
FIG. 3A is a view similar to FIG. 3, but with the lower rail assembly raised slightly, as during the initial stage of retraction.

During retraction of the rows, as the lowest row is retracted, the rail assembly also contracts and is tilted to assume a more upward inclination as shown in FIG. 3A. The link 39 rotates upwardly, and the sleeve 35 slides downwardly on the tubular element 30. Eventually, the rail assembly will be rotated until the upper peripheral ridge 37 clears the knuckle 47, and the sleeve 35 will engage the lower stop ridge 36. The final position during retraction is shown in FIG. 6, as discussed above.

The sequence of operations just described represents an ideal condition, and persons skilled in the art will readily appreciate that it may vary somewhat depending upon the frictional contact between tubes in each rail assembly, the frictional fitting of the sleeve of the uppermost tube 30, and so on.

The present invention does provide a folding rail assembly for a telescoping seating system which expands and contracts with the opening and closing of the seating system and which is easily accommodated to various rise and spans as are encountered in different installations. This is permitted principally because in the retracted position, the length of each individual rail assembly is greater than the distance between corresponding positions on adjacent posts, as best seen in FIG. 2.

Having thus described in detail a preferred embodiment to the invention, persons skilled in the art will be able to substitute equivalent elements for those illustrated and to modify certain of the structure described while continuing to practice the principle of the invention, and it is, therefore, intended that all such modifications and substitutions be covered as they are embraced within the spirit and scope of the appended claims.

I claim:

1. In combination with a telescoping seating system having a plurality of rows movable between an extended use position in which said rows are in stepped relation and a retracted position in which said rows are in superposed relation, a telescoping handrail comprising at least a pair of posts, one mounted to an upper row and the other to a lower row, a handrail comprising a plurality of telescoping tubular elements forming a rail assembly; means for pivotally mounting the lower end of said rail assembly to one of said posts; a sleeve slidably received on the uppermost tubular element of said rail assembly; and link means pivotally connected at one end to said sleeve and pivotally connected at the other end to the other of said posts.

2. The apparatus of claim 1 wherein each uppermost tubular element of a rail assembly includes upper and lower limit means for engaging said sleeve respectively when said rail assembly is extended and retracted for limiting the motion of the upper portion of said rail assembly.

3. The system of claim 2 wherein said upper and lower limit means each comprise a peripheral ridge extending outwardly of an associated upper tubular element of a rail assembly.

4. The system of claim 1 further comprising stop means interposed between said link and its associated post when said rail assembly is in an extended position to limit the pivoting of said rail assembly whereby all tubes of a rail assembly are substantially axially aligned with the tubular elements of a corresponding rail assembly of a higher or lower section.

5. The apparatus of claim 4 wherein said stop means is secured to said link.

6. The apparatus of claim 5 further comprising means for adjusting said stop means on said link to thereby adjust the position of said link relative to an associated post in the lowered position.

7. The system of claim 1 wherein said posts are forwardly inclined, whereby said rail assemblies assume a generally upright position in the retracted position.

8. The apparatus of claim 1 wherein the means for mounting said rail assemblies to a post comprises: a pin extending through an associated post, said link being journaled on said pin; a knuckle in the lowermost tubular element and journaled on said pin, and a spacer element between said link and said knuckle.

* * * * *